US010144146B2

(12) United States Patent
Frey et al.

(10) Patent No.: US 10,144,146 B2
(45) Date of Patent: Dec. 4, 2018

(54) WORK DEVICE

(71) Applicant: Andreas Stihl AG & Co. KG, Waiblingen (DE)

(72) Inventors: Benjamin Frey, Stuttgart (DE); Helmut Zimmermann, Berglen (DE); Klaus-Martin Uhl, Plochingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 15/513,997

(22) PCT Filed: Sep. 12, 2015

(86) PCT No.: PCT/EP2015/001833
§ 371 (c)(1),
(2) Date: Mar. 24, 2017

(87) PCT Pub. No.: WO2016/045773
PCT Pub. Date: Mar. 31, 2016

(65) Prior Publication Data

US 2017/0266834 A1 Sep. 21, 2017

(30) Foreign Application Priority Data

Sep. 26, 2014 (DE) ..... 10 2014 014 275

(51) Int. Cl.
*B27B 17/14* (2006.01)
*B27B 17/02* (2006.01)

(52) U.S. Cl.
CPC ..... *B27B 17/14* (2013.01); *B27B 17/02* (2013.01)

(58) Field of Classification Search
CPC ..... B27B 17/02; B27B 17/14; B27B 3/28; Y10T 83/7239; F16H 25/24; B23D 57/02
(Continued)

(56) References Cited

U.S. PATENT DOCUMENTS 3,382,898 A * 5/1968 Walker ..... B27B 17/14 30/382
5,070,618 A * 12/1991 Edlund ..... B27B 17/14 30/385

(Continued)

FOREIGN PATENT DOCUMENTS

JP 2002 036203 2/2002
WO WO 2004/078435 A1 * 9/2004 ..... B27B 17/14
WO 2005/108030 11/2005

*Primary Examiner* — Ghassem Alie
(74) *Attorney, Agent, or Firm* — Gudrun E. Huckett

(57) ABSTRACT

The invention relates to a work device with a guide rail (4) on which a chain (5) is driven in a circulating manner. The work device has a clamping device (15) for the chain (5). The clamping device (15) has a clamping element (16) which acts on en the guide rail (4) in the direction (19) of the longitudinal central axis (18) of the guide rail (4). The clamping device (15) has a rotatably mounted adjusting element (17) which is connected to the clamping element (16) via a threaded connection (20). A rotation of the adjusting element (17) about its rotational axis (21) causes a movement of the clamping element (16) in the direction (19) of the longitudinal central axis (18) of the guide rail (4). The outer circumference of the adjusting element (17) has a threaded portion (22) with at least one turn (23), said threaded portion being provided for engaging with at least one threaded portion (24) of the clamping element (16). The adjusting element (17) has an actuating contour (39) so that a user can rotate the adjusting element (17), said actuating contour comprising at least one depression. The largest spacing (b) between the threaded portion (22) of the adjusting element (17) and the rotational axis (21) is at least as large as the largest spacing (a) between the actuating contour (39) and the rotational axis (21).

19 Claims, 5 Drawing Sheets

(58) Field of Classification Search
USPC ..... 30/386, 385, 383, 387, 384, 122, 500, 30/382; 83/816, 817, 814, 818; 411/378, 411/271, 190
See application file for complete search history.

(56) References Cited

U.S. PATENT DOCUMENTS 5,983,508 A * 11/1999 Sundstrom ..... B27B 17/14 30/383
6,049,986 A * 4/2000 Calkins ..... B27B 17/025 30/383
8,495,819 B2 * 7/2013 Okouchi ..... B27B 17/14 30/386

* cited by examiner

Fig. 1
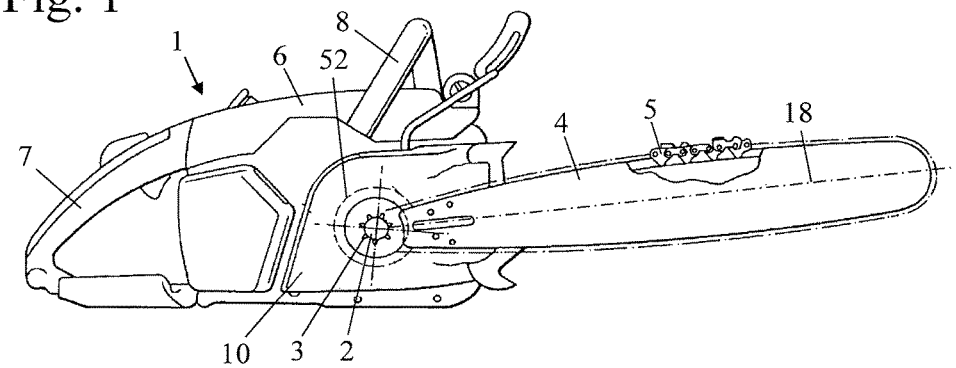
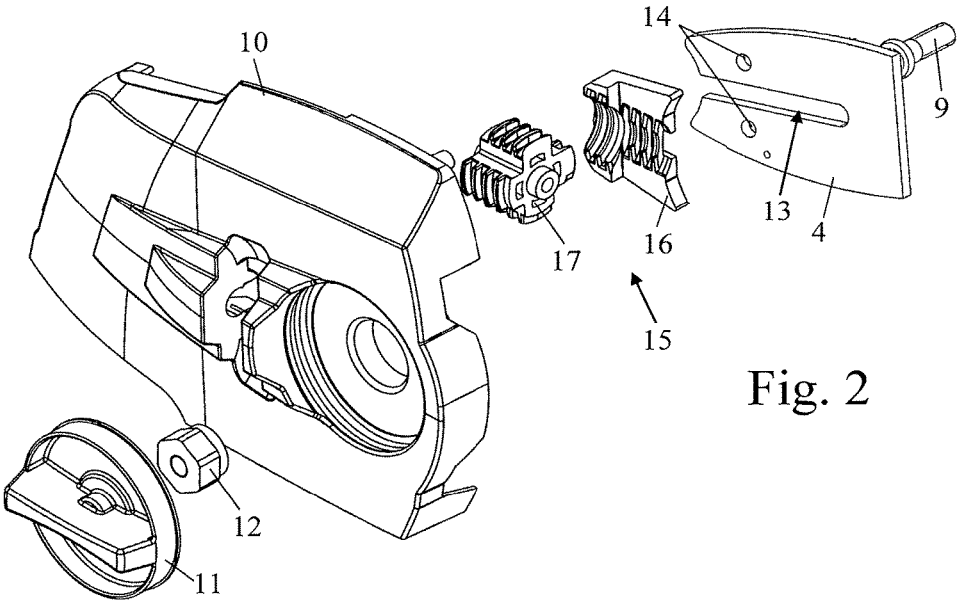
Fig. 2
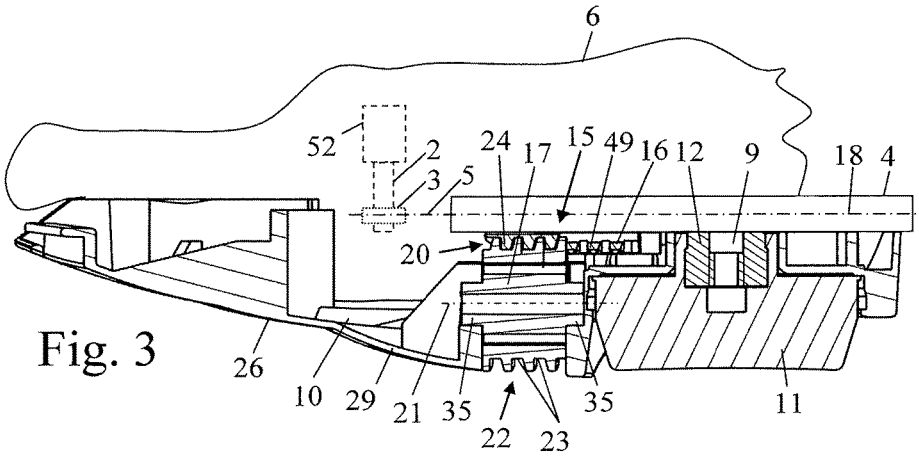
Fig. 3

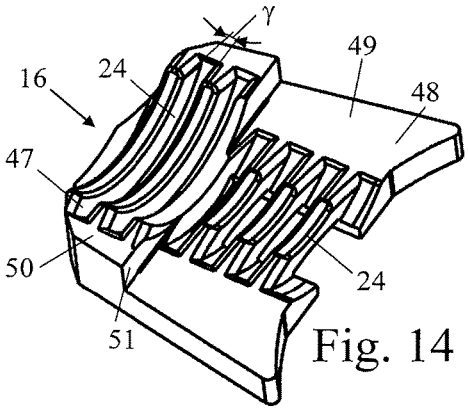
Fig. 14
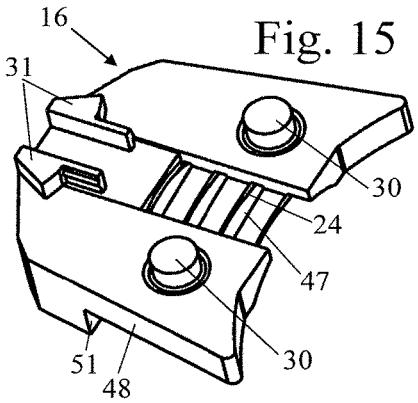
Fig. 15
Fig. 16
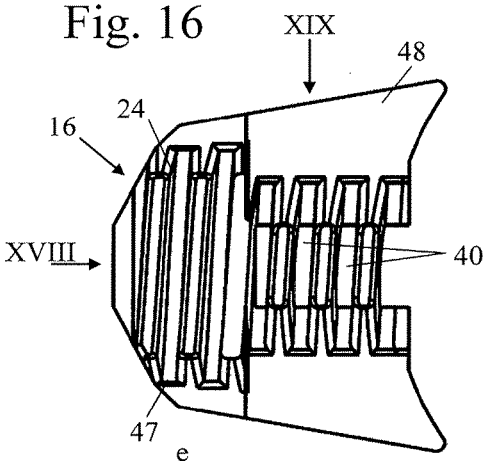
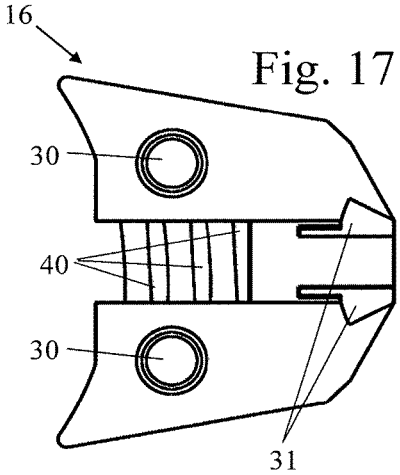
Fig. 17
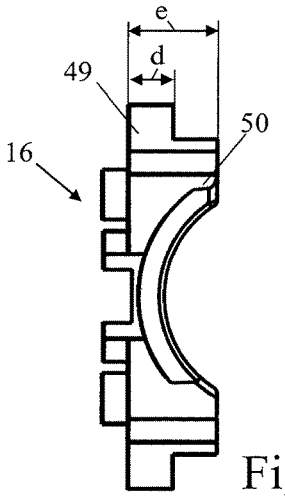
Fig. 18
Fig. 19
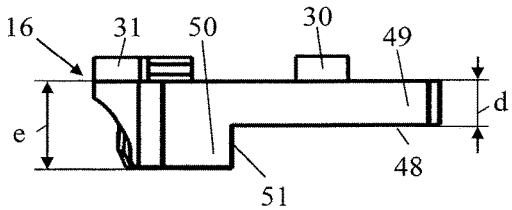

WORK DEVICE

BACKGROUND OF THE INVENTION

The invention concerns a work device with a guide bar on which a chain is driven in circulation, wherein the work device comprises a tensioning device for the chain, wherein the tensioning device comprises a tensioning member that is acting on the guide bar in direction of a longitudinal center axis of the guide bar, and wherein the tensioning device comprises a rotatably supported adjusting member that is connected by a threaded connection with the tensioning member, wherein turning of the adjusting member about its axis of rotation effects a movement of the tensioning member in the direction of the longitudinal center axis of the guide bar, wherein the adjusting member comprises on its outer circumference a threaded section with at least one thread turn that is provided for engagement with at least one threaded section of the tensioning member, and wherein the adjusting member comprises an actuating contour that comprises at least one recess for turning of the adjusting member by an operator.

WO 2005/108030 A1 discloses a power saw with a saw chain that is driven to circulate about guide bar and can be tensioned by means of a tensioning device. The tensioning device comprises a rotatably supported adjusting screw with a screw head and a screw shaft. The screw shaft acts by means of a threaded connection on a tensioning member secured on the guide bar. Turning of the adjusting screw effects by means of the threaded connection a lengthwise displacement of the guide bar so that the saw chain is tensioned. In order for the saw chain to be tensioned, the operator must apply a great torque to the screw head. Due to the small diameter of the screw shaft, the transmittable tensioning forces are limited.

The invention has the object to provide a work device of the aforementioned kind that has a simple configuration and enables transmission of comparatively high tensioning forces.

SUMMARY OF THE INVENTION

This object is solved in that the greatest spacing of the threaded section of the adjusting member relative to the axis of rotation is at least as great as the greatest spacing of the actuating contour relative to the axis of rotation.

It is provided that the greatest spacing of the threaded section of the adjusting member relative to the axis of rotation is at least as large as the greatest spacing of the actuating contour relative to the axis of rotation. Due to the comparatively great outer circumference of the threaded section relative to the outer circumference of the actuating contour, great forces can be transmitted from the adjusting member onto the tensioning member. At the same time, a simple configuration results because no additional components are required for the transmission of comparatively high forces.

Advantageously, the at least one recess of the actuating contour of the adjusting member interrupts the at least one thread turn of the adjusting member at least partially. Accordingly, the recess and the thread turn overlap each other at least partially. Advantageously, the actuating contour extends across a length section of the adjusting member and the thread turn of the adjusting member extends across the entire length of this length section. Due to the overlap of actuating contour and threaded section in the length section of the adjusting member, a minimal construction length of the adjusting member can be achieved. This provides for a compact configuration of the adjusting member with minimal length. Due to the compact configuration of the adjusting member, the adjusting member is lightweight so that a weight reduction of the work device results.

Preferably, the adjusting member has a base member with a cylindrical outer surface and the actuating contour and the threaded section extend respectively across the entire axial length of the base member of the adjusting member. In this way, the adjusting member is of a very compact configuration but the actuating contour and the threaded section are still embodied as large as possible.

Expediently, the actuating contour is formed by at least one, preferably by at least three, in particular at least four, grooves. Expediently, the longitudinal direction of the at least one groove of the actuating contour is positioned at an angle of at most approximately 40° relative to the axis of rotation of the adjusting member. In particular, the longitudinal direction of the at least one groove of the actuating contour extends parallel to the axis of rotation of the adjusting member. Expediently, the flanks of the groove in a section plane perpendicular to the axis of rotation of the adjusting member are positioned at an angle that amounts to from approximately 60° to approximately 120°, in particular from approximately 70° to approximately 110°. The great angle enables a wide opening at the circumference of the adjusting member so that the operator can reach easily between the flanks and rotate the adjusting member.

Advantageously, the work device comprises a chain sprocket cover on which the adjusting member is rotatably supported, wherein the adjusting member is supported in the direction of the axis of rotation on the chain sprocket cover. In this way, the adjusting member is held in the chain sprocket cover and the chain sprocket cover can be easily mounted together with the adjusting member. Since the adjusting member is supported on the chain sprocket cover and not immediately on the housing, the tensioning force is transmitted by means of the chain sprocket cover into the housing.

Preferably, the chain sprocket cover has an opening through which the base member of the adjusting member projects at least partially to the exterior side of the chain sprocket cover. The chain sprocket cover has advantageously a grip depression on at least one side of the opening which is extending parallel to the axis of rotation of the adjusting member. In this way, the adjusting member is easily accessible for an operator. Moreover, dirt which has deposited in the tensioning device, for example, sawdust, can exit through the opening. The dirt is conveyed through the opening by rotation of the adjusting member.

Expediently, the adjusting member has at its end faces bearing pins which are held in receptacles of the chain sprocket cover. Expediently, the bearing pins are clipped into receptacles of the chain sprocket cover. The bearing pins can also be held in a bearing cup which is formed on a bearing cover wherein the bearing cover is fastened to the chain sprocket cover.

Advantageously, the work device comprises an actuating element for fixation of the chain sprocket cover on the housing of the work device that is arranged adjacent to the tensioning device on the chain sprocket cover. In this way, an operator can tension the chain, in particular saw chain, by rotation of the adjusting member with one hand, for example, and, after reaching the desired saw chain tension, can secure the chain sprocket cover on the housing of the work device with the other hand by adjustment of the actuating element.

Preferably, the tensioning member is configured disk-shaped and supports on one flat side the threaded section, wherein the threaded section is formed by partial sections of neighboring thread turns. The flat side which is supporting the threaded section has advantageously a step which is extending transverse to the longitudinal center axis of the guide bar, wherein the thickness of the tensioning member on the side of the step which is facing the fastening element is reduced. In this way, the tensioning member can be pushed into the area of the fastening element so that a greater tensioning travel of the tensioning device for minimal construction width of the saw is provided. In this way, the work device, in particular in transverse direction, i.e., in the direction of the axis of rotation of the drive shaft, is of a compact and narrow configuration. The actuating element can be designed to be comparatively large so that an operator can simply and comfortably actuate the actuating element.

Expediently, the outer diameter of the adjusting member amounts to at least 15 mm, in particular at least 20 mm. Due to the comparatively large outer diameter, a great force is transmittable from the adjusting member by means of the threaded sections onto the tensioning member. Even with minimal strength, the adjusting member can apply high tensioning forces. Moreover, due to the comparatively great outer diameter of the adjusting member, a large thread diameter is made possible wherein as a result of the large thread diameter the load of the thread flanks, compared to an adjusting member with smaller outer diameter and smaller thread diameter, is reduced for the same load so that the threaded section of the adjusting member can be comprised of plastic material, for example.

Advantageously, the tensioning member comprises a pin which engages an opening of the guide bar and in this way connects the tensioning member with form fit with the guide bar in the direction of the longitudinal center axis of the guide bar. Expediently, the threads of the threaded connection are trapezoidal threads, wherein the flank angles of the trapezoidal threads amount to from 0° to 60°.

Advantageously, the threaded section of the adjusting member and the threaded section of the tensioning member are comprised of plastic material, in particular of fiber-reinforced plastic material. In this way, the weight of the adjusting member and the weight of the tensioning member are comparatively low so that the total weight of the work device is reduced. Expediently, the adjusting member and the tensioning member are completely made of plastic material, in particular of fiber-reinforced plastic material.

Expediently, the work device is a power saw. It can also be expedient that the work device is a concrete cutter.

BRIEF DESCRIPTION OF THE DRAWINGS

An embodiment of the invention will be explained in the following with the aid of the drawing. It is shown in:

FIG. 1 a schematic illustration of a work device;

FIG. 2 a perspective exploded view of actuating element, chain sprocket cover, tensioning device, and guide bar of the work device of FIG. 1;

FIG. 3 a schematic section illustration through the chain sprocket cover, the tensioning device, the actuating element, and the guide bar;

FIGS. 14 and 15 perspective views of the tensioning member;

FIGS. 16 and 17 side views of the tensioning member;

FIG. 18 a side view of the tensioning member in direction of arrow XVIII in FIG. 16;

FIG. 19 a side view of the tensioning member in direction of arrow XIX of FIG. 16.

DESCRIPTION OF PREFERRED EMBODIMENTS

Figure 4:
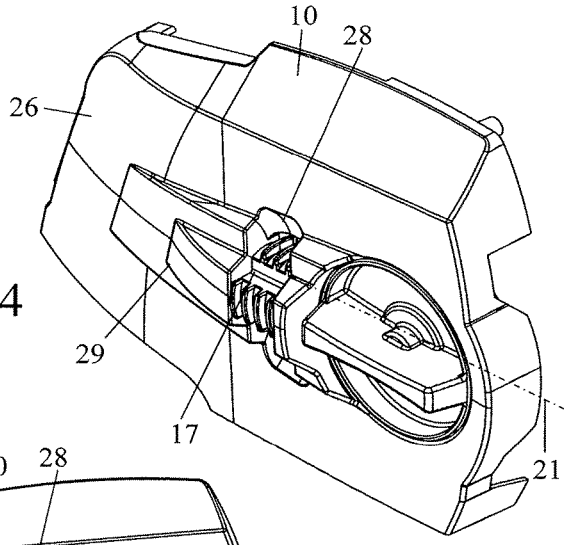
FIG. 4 a perspective view of the chain sprocket cover with adjusting member and actuating element.

FIG. 1 shows a power saw 1 as an embodiment of a work device. The power saw 1 comprises a housing 6 in which a drive motor 52, for example, an internal combustion engine or an electric motor, is arranged. When the drive motor 52 is embodied as an electric motor, the electric motor can obtain its energy by means of a battery pack, not illustrated. The drive motor 52 drives a chain 5 by means of a drive shaft 2 and a drive pinion 3. In the embodiment, the chain 5 is designed as a saw chain. In the area of the drive pinion 3, a chain sprocket cover 10 is secured on the housing 6. The power saw 1 comprises a guide bar 4. In operation, the chain 5 circulates about the guide bar 4. Handles, i.e., a rear handle 7 as well as a grip pipe 8, are secured on the housing 6 for guiding the power saw 1.

The power saw 1 comprises a tensioning device 15 illustrated in FIG. 2 for tensioning the chain 5. The tensioning device 15 comprises a tensioning member 16 and an adjusting member 17. For tensioning the chain 5, the guide bar 4 is moved relative to the housing 6 in the direction of a longitudinal center axis 18 (FIG. 1) of the guide bar 4. For this purpose, the tensioning member 16 engages with form fit two circular openings 14 provided on the guide bar 4 so that forces from the tensioning member 16 can be transmitted onto the guide bar 4, in particular in the direction of the longitudinal center axis 18 of the guide bar 4.

The guide bar 4 comprises a longitudinal slot 13. On the housing 6 a bolt 9 is secured which engages the longitudinal slot 13. The longitudinal slot 13 enables the movement of the guide bar 4 in the direction of the longitudinal center axis 18 of the guide bar 4. An actuating element 11 which comprises a nut 12 can be screwed onto the bolt 9. In the secured state illustrated in FIG. 3, the chain sprocket cover 10 covers the tensioning device 15 and the drive pinion 3. The chain sprocket cover 10 is secured by means of the actuating element 11 screwed onto the bolt 9 on the housing 6 schematically shown in FIG. 3. In the secured state, the guide bar 4 is clamped by the actuating element 11 between the chain sprocket cover 10 and the housing 6.

The adjusting member 17 is rotatably supported about an axis of rotation 21 in the chain sprocket cover 10. The adjusting member 17 is connected by a threaded connection 20 with the tensioning member 16. Due to the threaded connection 20, turning of the adjusting member 17 about its axis of rotation 21 effects a movement of the tensioning member 16 in the direction of the longitudinal center axis 18 of the guide bar 4.

The adjusting member 17 comprises on its outer circumference a threaded section 22 with four thread turns 23. The tensioning member 16 comprises a threaded section 24. The threaded section 22 of the adjusting member 17 is provided for engagement of the threaded section 24 of the tensioning member 16 whereby the threaded connection 20 is formed. Upon turning of the adjusting member 17 about its axis of rotation 21, the tensioning member 16 moves in direction of the longitudinal center axis 18 of the guide bar 4. Since the tensioning member 16 is connected with form fit with the guide bar 4, the guide bar 4 together with the tensioning member 16 is adjusted in direction of the longitudinal center axis 18. In this way, the tension of the chain 5 is adjusted.

Once the desired tension of the chain 5 has been adjusted, the actuating element 11 is tightened on the bolt 9 by means of the molded-in nut 12 in the actuating element 11. In this way, the guide bar 4 is clamped between bolt 9 and nut 12.

Figure 5:
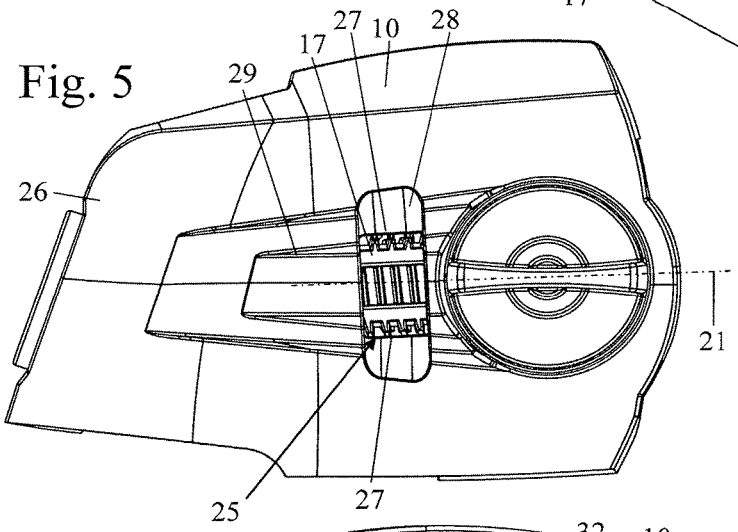
FIG. 5 a side view of the chain sprocket cover, of the adjusting member, and of the actuating element.
Figure 8:
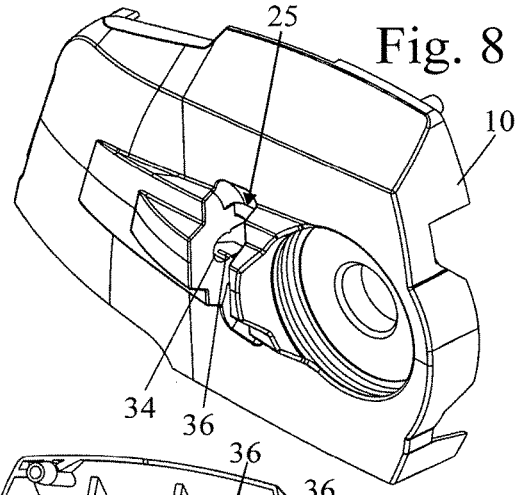
FIGS. 8 and 9 perspective views of the chain sprocket cover.

The chain sprocket cover 10 comprises an opening 25 shown in FIGS. 5 and 8. The adjusting member 17 illustrated in FIGS. 4 and 5 projects at least partially through the opening 25 to an exterior side 26 of the chain sprocket cover 10 so that an operator can turn the adjusting member 17 from the exterior. So that the operator can turn the adjusting member 17 easily, the chain sprocket cover 10 comprises a grip depression 28 which extends on the sides 27 of the opening 25 that are extending parallel to the axis of rotation 21 of the adjusting member 17.

On the chain sprocket cover 10 in the area of the opening 25 an elevation 29 is provided which is formed monolithic with the chain sprocket cover 10. As shown in FIG. 3, the elevation 29 curves toward the exterior side 26 of the chain sprocket cover 10 and ends approximately flush with the adjusting member 17 in the area of the adjusting member 17. The elevation 29 and the adjusting member 17 are at least partially positioned in one plane.

Figure 6:
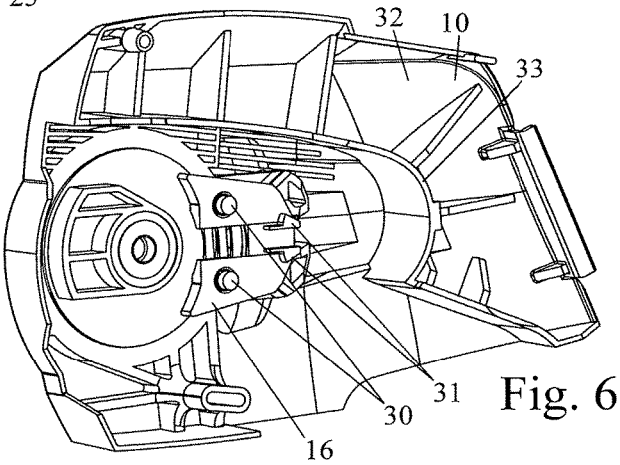
FIG. 6 a perspective view of the chain sprocket cover and of the tensioning member.
Figure 7:
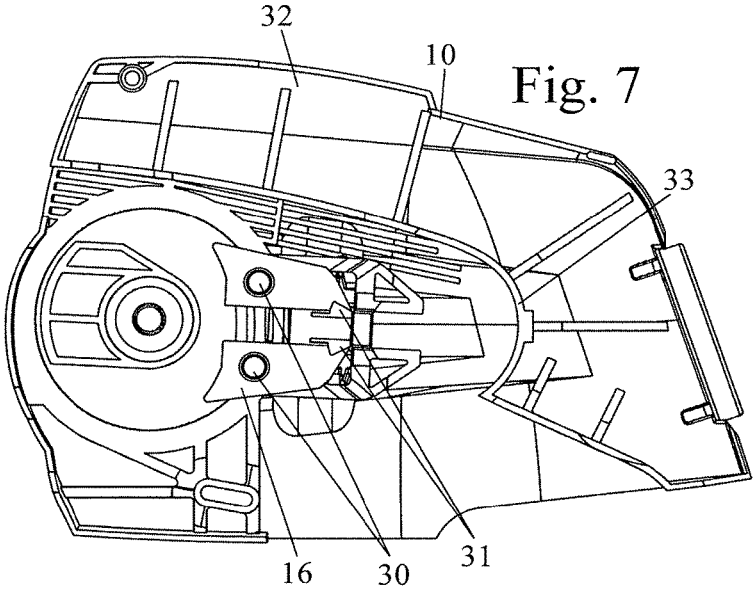
FIG. 7 a side view of the chain sprocket cover and of the tensioning member.

As shown in FIGS. 6 and 7, the tensioning member 16 has two pins 30. In the installed state, the pins 30 engage the openings 14 of the guide bar 4 (FIG. 2) and connect in this way the tensioning member 16 with form fit with the guide bar 4 in the direction of the longitudinal center axis 18 (FIG. 1) of the guide bar 4. Guide elements 31 are provided on the tensioning member 16. With the guide bar 4 installed, the hook-shaped guide elements 31 project into the longitudinal slot 13 of the guide bar 4 (FIG. 2) and are contacting the guide bar 4 on the side of the guide bar 4 facing the drive pinion 3.

As also shown in FIGS. 6 and 7, a wall 33 is arranged on an inner side 32 of the chain sprocket cover 10. The wall 33 delimits in outward direction a channel in which the saw chain (FIG. 1) is running. In this way, it is mostly prevented that sawdust can lodge in the chain sprocket cover 10.

Figure 9:
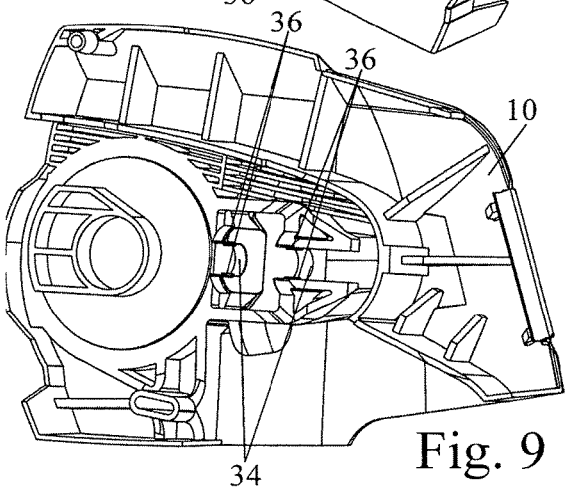

As shown in FIGS. 8 and 9, on the chain sprocket cover 10 receptacles 34 for rotatable support of the adjusting member 17 (FIG. 3) are provided. Each one of the receptacles 34 extends approximately as a semi-circle. In the receptacles 34 bearing pins 35 (FIG. 3) are held which are provided on the end faces of the adjusting member 17. In the embodiment, locking noses 36 are provided on the receptacles 34 so that the cylinder-shaped bearing pins 35 of the adjusting member 17 (FIG. 3) can be clipped into the receptacles 34 of the chain sprocket cover 10. In a further embodiment, a bearing cover, not illustrated, can also be provided that comprises receptacles 34 for the bearing pins 35 and is fastened to the chain sprocket cover 10, for example, is screwed to the chain sprocket cover 10.

Figure 10:
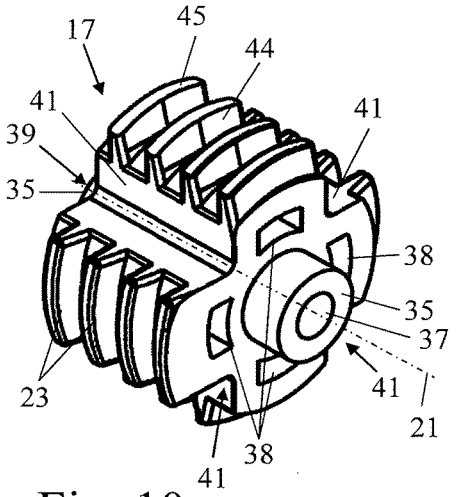
FIG. 10 a perspective view of the adjusting member.
Figure 11:
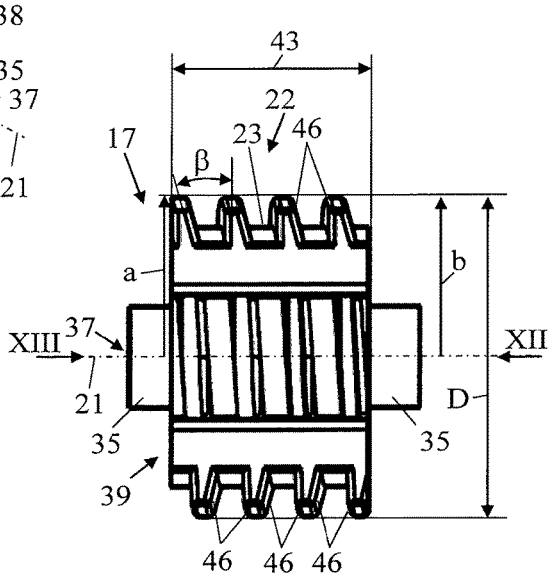
FIG. 11 a side view of the adjusting member.
Figure 12:
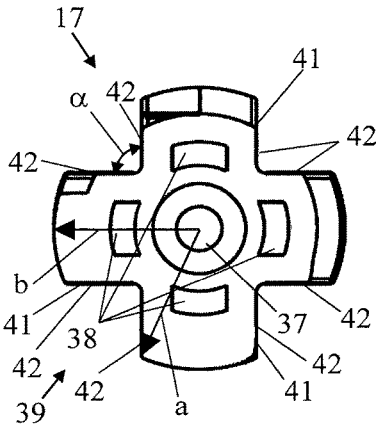
FIG. 12 a side view of the adjusting member in direction of arrow XII of FIG. 11.
Figure 13:
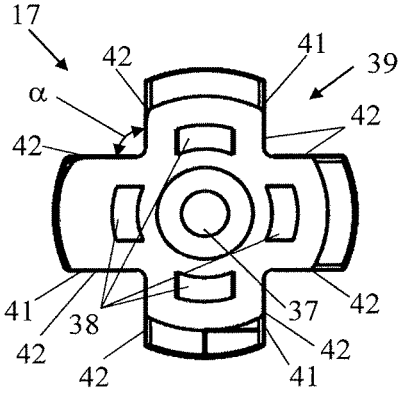
FIG. 13 a side view of the adjusting member in direction of arrow XIII of FIG. 11.

As shown in FIGS. 10 to 13, the adjusting member 17 has an actuating contour 39. An operator can turn the adjusting member 17 at the actuating contour 39. The actuating contour 39 comprises in the embodiment four recesses which interrupt the thread turns 23. In the embodiment, the recesses are embodied as grooves 41. Each one of the grooves 41 is delimited by two flanks 42 (FIGS. 12 and 13). The flanks 42 of the grooves 41 are positioned at an angle $\alpha$ relative to each other, respectively, which in the embodiment amounts to approximately 90°. The angle $\alpha$ is advantageously in a range of approximately 60° to approximately 120°, in particular from approximately 70° to approximately 110°.

The longitudinal direction of the groove 41 extends in the embodiment parallel to the axis of rotation 21 (FIG. 10). In a further embodiment, the longitudinal direction of the at least one groove 41 can extend, in a side view of the adjusting member 17, at an angle relative to the axis of rotation 21 of the adjusting member 17, wherein the angle is advantageously at most 40°.

The adjusting member 17 comprises a base member 44 with a cylindrical outer surface 45, wherein the cylindrical outer surface 45 is interrupted by the grooves 41 and the thread turns 23. The actuating contour 39 extends across the entire axial length of the cylindrical base member 44 of the adjusting member 17. Also, the threaded section 22 of the adjusting member 17 extends across the entire axial length of the base member 44 of the adjusting member 17, respectively. However, it can also be advantageous that the grooves 41 and the thread turns 23 extend only across a partial section of the axial length of the base member 44 and advantageously only partially overlap in axial direction. The actuating contour 39 comprises the greatest spacing a relative to the axis of rotation 21 which in the embodiment is of the same size as the greatest spacing b of the outer circumference of the threaded section 22 of the adjusting member 17 relative to the axis of rotation 21. The outer diameter D of the adjusting member 17, which in the embodiment is identical to the outer diameter of the outer circumference of the threaded section 22 of the adjusting member 17, advantageously amounts to at least 15 mm, in particular at least 20 mm.

As is shown in FIG. 11, the thread of the threaded section 22 is designed as a trapezoidal thread 46 whose flank angle $\beta$ amounts to at most 60°. As illustrated in FIGS. 14 to 17, the thread of the threaded section 24 of the tensioning member 16 is also designed as a trapezoidal thread 47 whose flank angle $\gamma$ (FIG. 14) amounts to at most 60°.

The threaded section 22 of the adjusting member 17 (FIGS. 10 to 13) and the threaded section 24 of the tensioning member 16 (FIGS. 14 to 16) are comprised of plastic material, in particular of fiber-reinforced plastic material. In the embodiment, the adjusting member 17 and the tensioning member 16 are completely comprised of plastic material.

As shown in FIGS. 10 to 13, the adjusting member 17 has a central bore 37. The axis of the central bore 37 corresponds to the axis of rotation 21. The central bore 37 penetrates the adjusting member 17 completely and serves as a weight reducing bore. Displaced radially in outward direction, several, i.e., four, channels 38 are formed in the embodiment that extend parallel to the central bore 37 and penetrate the adjusting member 17 completely. The channels 38 are also provided for weight reduction.

As shown in FIGS. 14 to 19, the tensioning member 16 is of a flat configuration. On one flat side 48, the tensioning member 16 supports the threaded section 24. The threaded section 24 is not formed by complete thread turns but by partial sections of neighboring thread turns. The tensioning member 16 comprises at its flat side 48 a step 51 extending transverse to the longitudinal center axis 18 of the guide bar 4 (FIG. 3) and transverse to the plane of the guide bar 4. As shown in FIGS. 18 and 19, the thickness d of the tensioning member 16 in a first partial area 49 of the tensioning member 16 is smaller than the thickness e of the tensioning member 16 in a second partial area 50 of the tensioning member 16. The thicknesses d and e are measured perpendicular to the plane of the guide bar 4. In this way, the partial sections of the thread turns of the threaded section 24 in the first partial area 49 are flatter sections of a complete thread turn than the partial sections of the thread turns in the second partial area 50. The partial area 49 with reduced thickness d is arranged so as to face the actuating element 11 (FIG. 2), as shown in FIG. 3. When adjusting the tensioning member 16 in the direction of the longitudinal center axis 18, the step 51 ensures that the tensioning member 16 can move underneath the actuation element 11.

On the side which is facing away from the flat side 48, the tensioning member 16 supports the pins 30 and the guide elements 31. As shown in FIG. 17, penetrations 40 are formed in the partial area 49 between neighboring thread turns. In this way, a very minimal thickness d is achieved. At the same time, upon turning of the adjusting member 17 dirt can be moved out of the thread turns of the tensioning member 16.

In the embodiment, the tensioning member 16 is a separate component. However, it can also be expedient that the tensioning member 16 is embodied as a part of the guide bar 4.

What is claimed is:

1. A work device comprising:

a guide bar having a longitudinal center axis;

a chain driven in circulation about the guide bar;

a tensioning device comprising a tensioning member acting on the guide bar in a direction of the longitudinal center axis to tension the chain;

the tensioning device further comprising a rotatably supported adjusting member;

the tensioning member comprising at least one threaded section;

the adjusting member comprising a threaded section on an outer circumference of the adjusting member, the threaded section of the adjusting member comprising at least one thread turn engaging the at least one threaded section of the tensioning member to form a threaded connection between the adjusting member and the tensioning member, wherein turning of the adjusting member about an axis of rotation of the adjusting member effects a movement of the tensioning member in the direction of the longitudinal center axis of the guide bar;

the adjusting member comprising an actuating contour that comprises at least one recess enabling an operator to act on and turn the adjusting member;

the threaded section of the adjusting member comprising a first greatest spacing relative to the axis of rotation and the actuating contour comprising a second greatest spacing relative to the axis of rotation, wherein the first greatest spacing is at least as great as the second greatest spacing;

a chain sprocket cover that comprises an opening, wherein the adjusting member projects at least partially through the opening to an exterior side of the chain sprocket cover so that an operator can turn the adjusting member through the actuating contour from the exterior side.

2. The work device according to claim 1, wherein the at least one recess of the actuating contour at least partially interrupts the at least one thread turn of the threaded section of the adjusting member.

3. The work device according to claim 1, wherein the actuating contour extends across a length section of the adjusting member and wherein the threaded section of the adjusting member extends across an entire length of said length section.

4. The work device according to claim 3, wherein the adjusting member comprises a base member with a cylindrical outer surface and wherein the actuating contour and the threaded section of the adjusting member extend across an entire axial length of the base member, respectively.

5. The work device according to claim 1, wherein the actuating contour is formed by at least one groove.

6. The work device according to claim 5, wherein a length direction of the groove of the actuating contour extends at an angle of at most approximately 40° relative to the axis of rotation of the adjusting member.

7. The work device according to claim 5, wherein the groove has flanks and the flanks of the groove, in a section plane perpendicular to the axis of rotation of the adjusting member, are positioned at an angle relative to each other that amounts to approximately 60° to approximately 120°.

8. The work device according to claim 1, wherein the adjusting member is rotatably supported in a direction of the axis of rotation on the chain sprocket cover.

9. The work device according to claim 8, wherein a base member of the adjusting member projects at least partially through the opening of the chain sprocket cover to the exterior side of the chain sprocket cover.

10. The work device according to claim 9, wherein the chain sprocket cover comprises a grip depression disposed on at least one side of the opening, wherein the at least one side of the opening extends parallel to the axis of rotation of the adjusting member.

11. The work device according to claim 8, wherein the adjusting member comprises bearing pins arranged on opposite end faces of the adjusting member, wherein the chain sprocket cover comprises receptacles, and wherein the bearing pins are held in the receptacles of the chain sprocket cover.

12. The work device according to claim 8, further comprising a housing and an actuating element securing the chain sprocket cover on the housing, wherein the actuating element is arranged adjacent to the tensioning device on the chain sprocket cover.

13. The work device according to claim 12, wherein the tensioning member is disk-shaped and comprises a flat side, wherein the at least one threaded section of the tensioning member is arranged on the flat side, wherein the at least one threaded section of the tensioning member is formed by partial sections of neighboring thread turns, and wherein the flat side comprises a step extending transversely to the longitudinal center axis of the guide bar, wherein a thickness of the tensioning member is reduced at a side of the step facing the actuating element.

14. The work device according to claim 1, wherein an outer diameter of the adjusting member amounts to at least 15 mm.

15. The work device according to claim 1, wherein the tensioning member comprises at least one pin that engages an opening of the guide bar and that connects the tensioning member with form fit with the guide bar in a direction of the longitudinal center axis of the guide bar.

16. The work device according to claim 1, wherein threads of the threaded connection formed by the threaded section of the adjusting member and the at least one threaded section of the tensioning member are trapezoidal threads, wherein a flank angle of the trapezoidal threads amounts to from 0° to 60°.

17. The work device according to claim 1, wherein the threaded section of the adjusting member and the at least one threaded section of the tensioning member are comprised of plastic material.

18. The work device according to claim 1, wherein the at least one recess is a groove.

19. The work device according to claim 1, wherein the adjusting member is comprised of plastic material.

* * * * *